US006483255B1

(12) United States Patent
Vollkommer et al.

(10) Patent No.: US 6,483,255 B1
(45) Date of Patent: Nov. 19, 2002

(54) GAS DISCHARGE LAMP WITH SEPARATELY OPERATING ELECTRODE GROUPS

(75) Inventors: Frank Vollkommer, Buchendorf (DE); Lothar Hitzschke, Munich (DE); Simon Jerebic, Munich (DE)

(73) Assignee: Patent-Treuhand-Gesellschaft fuer Elektrische Gluehlampen mbH

( * ) Notice: Subject to any disclaimer, the term of this patent is extended or adjusted under 35 U.S.C. 154(b) by 0 days.

(21) Appl. No.: 09/355,521

(22) PCT Filed: Dec. 11, 1998

(86) PCT No.: PCT/EP98/08106

§ 371 (c)(1),
(2), (4) Date: Jul. 29, 1999

(87) PCT Pub. No.: WO99/34411

PCT Pub. Date: Jul. 8, 1999

(30) Foreign Application Priority Data

Dec. 23, 1997 (EP) ..... 97122799
Apr. 20, 1998 (DE) ..... 198 17 479

(51) Int. Cl.[7] ..... H05B 41/16
(52) U.S. Cl. ..... 315/246; 315/58; 313/485
(58) Field of Search ..... 315/58, 169.1, 315/237, 324, 246; 313/485, 488, 491

(56) References Cited

U.S. PATENT DOCUMENTS

| | | | | |
|---|---|---|---|---|
| 5,444,335 A | * | 8/1995 | Matsumoto et al. | 315/246 |
| 5,479,071 A | | 12/1995 | Lynn | 313/514 |
| 6,139,384 A | * | 10/2000 | DeTemple | 445/24 |
| 6,346,770 B1 | * | 2/2002 | Schoenbach et al. | 313/491 |

FOREIGN PATENT DOCUMENTS

| | | |
|---|---|---|
| DE | 19526211 | 1/1997 |
| DE | 19636965 | 3/1998 |
| EP | 0766286 | 4/1997 |
| EP | 0926704 | 6/1999 |
| EP | 0926705 | 6/1999 |
| EP | 0932185 | 7/1999 |
| WO | 9109414 | 6/1991 |
| WO | 9423442 | 10/1994 |
| WO | 9704625 | 2/1997 |
| WO | 9843276 | 10/1998 |
| WO | 9843277 | 10/1998 |

* cited by examiner

*Primary Examiner*—Don Wong
*Assistant Examiner*—Jimmy T. Vu
(74) *Attorney, Agent, or Firm*—Robert F. Clark

(57) ABSTRACT

The description relates to gas-discharge lamps having electrode structures for dielectrically inhibited discharges, in which the electrodes are divided into separately operable groups for independently switchable operation.

12 Claims, 5 Drawing Sheets

GAS DISCHARGE LAMP WITH SEPARATELY OPERATING ELECTRODE GROUPS

FIELD OF THE INVENTION

This invention relates to gas-discharge lamps. In this context, it relates to the specific field of gas-discharge lamps for dielectrically inhibited discharges, i.e. gas-discharge lamps in which the electrodes, or in any case at least the anodes, are isolated by a dielectric layer from the gas filling for the discharge.

PRIOR ART

Such gas-discharge lamps for dielectrically inhibited discharges have most recently become the subject of increased attention because they are able to exhibit various technical properties due to which they appear to be suitable, above all, as flat radiating elements for backlighting liquid crystal screens. The present invention does not primarily relate to this field of application and is also not restricted to flat radiating elements.

In the vast majority of cases, gas-discharge lamps for dielectrically inhibited discharges have electrode arrangements with a multiplicity of electrodes for producing a multiplicity of spatially distributed partial discharges. In flat radiating elements, this is used to backlight a surface expanse as uniformly as possible, for example.

DESCRIPTION OF THE INVENTION

This invention is based on the technical problem of developing gas-discharge lamps for dielectrically inhibited discharges with a view to increasing the options for application and use.

The invention solves this problem by means of a gas-discharge lamp having a discharge vessel which is filled with a gas filling, has a multiplicity of electrodes and has a dielectric layer between at least one anode part of the electrodes and the gas filling, wherein the electrodes are divided into separately operable groups for independently switchable operation.

It also relates to a traffic light as claimed in claim 8, a display device or signal lamp as claimed in claim 9 and an interior light as claimed in claim 10.

The basic concept of the invention thus involves, with a multiplicity of electrodes in a gas-discharge lamp for dielectrically inhibited discharges, dividing the electrodes into groups that can be operated in electrical isolation, that is to say making it possible for some of the anodes and/or some of the cathodes to be driven separately in electrical terms, and similarly making it possible for the other or some more of the cathodes and/or anodes to be electrically driven in the same way, but independently of the first ones. This produces electrode groups for independently switchable operation, with cathodes and anodes in one group being allocated to one another in terms of spatial arrangement, so that they can develop discharges amongst one another. The division into groups can be based on the electrical isolation of cathodes or anodes or on interaction between an electrical isolation of the cathodes and one of the anodes.

At this point, and in the following text, the terms anode and cathode should moreover not be understood as being restricted to unipolar operation. For bipolar operation of the electrodes, there is no difference between anodes and cathodes in this respect, so that respective statements for anodes or cathodes are valid for both "electrode types" in the bipolar case.

In this context, the invention preferably relates to so-called flat radiating elements. In the case of these, a discharge volume is formed from plates, for example made of glass, which are not necessarily planar in the sense of straight, but are areal and largely planar, with the electrode structures being produced on one or both glass plates. The distribution of electrodes over a large surface and possibly the use of additional diffuser layers allow flat lamps with a large surface and very uniform distribution of light to be produced. Areal production of light is an essential feature in many applications. These may involve backlighting a surface having a particular expanse or distributing a particular light power onto a surface in order to reduce the dazzling effect. An areal configuration may also be important for reasons of aesthetic design or for reducing the formation of shadows.

The invention may be particularly advantageous in just such flat radiating element applications, particularly if, according to a preferred embodiment, the groups that are to be operated independently correspond to different luminous surfaces. The luminous surfaces are then to be operated independently of one another, therefore, the luminous surfaces still being part of the same gas-discharge lamp, that is to say in particular of the same discharge vessel. Examples are advertising panels, in which various graphical elements are operated independently of one another, for example some flashing and some permanently illuminated.

A further example is signal lamps, whose different graphical elements correspond to the electrically isolated groups. In this case, it may be important to increase the conspicuousness, as is also the case for the advertising surfaces already mentioned. Alternatively, the symbolization of particular incorporated meanings may be involved, for example through successive activation of various luminous surfaces showing a continuous arrow movement or the like. A further possibility is the use of various, alternatively selectable luminous surfaces having different meanings for matching the meaning of one and the same signal lamp to various situations.

In the context of display devices, in the field of advertising as well, or signal devices, it is furthermore preferable to adapt the electrode geometry to match the respective surface shape to be backlit by an electrode group. According to this, the corresponding electrode group then essentially "fills" the relevant luminous surface, but does not go far beyond this into regions which do not need to be backlit at all. With regard to this feature, reference is made, by way of addition, to European Patent Application 97 122 799.6 from the same applicant, entitled "Flächstrahler mit örtlich modulierter Fl ächenleuchtdichte [Flat radiating element with locally modulated surface luminous intensity]".

Preferred shapes for an electrode geometry adapted in this manner are, particularly in the case of technical display devices, circular, circle-segment-shaped, annular or annular-segment-shaped surfaces. These are found in many analog displays. Reference is also made to the second exemplary embodiment.

Within the scope of the invention, there is no need whatsoever for the electrode groups which can be operated in electrical isolation to correspond to locally separate luminous surfaces as well. Hence, it may also be advantageous according to the invention to interleave two or more electrode groups that can be operated in electrical isolation within one and the same luminous surface such that each of the electrode groups can backlight the luminous surface substantially uniformly. By doing this, it is possible to produce, by way of example, a function similar to a dimmer function (in addition to such a function, as well), in that operating individual electrode groups with different powers or particular combinations of electrode groups makes the same luminous surface appear with different luminous intensities.

In particular, this allows (discrete) brightness reduction without the circuit complexity of a dimmer function. It is sufficient to separate the electrode groups and a corresponding switching device for selectively supplying individual groups or a number of the groups, in which case the power of the electronic ballast need not be controllable. Alternatively, it can be worthwhile to combine this technology with a dimmer function. This is because it has been found that, during dimming, that is to say when the power of an electronic ballast is reduced, problems can occur in the range of, in comparison to the rated power, very low powers. In this respect, using the fact that individual electrode groups can be switched separately, as described above, and using an additional dimmer function which, however, covers only one power range in the vicinity of the respective rated power of an electrode group, it is possible to find a worthwhile combination which can be dimmed down a long way, too, by disconnecting groups.

There may naturally also be cases in which there is neither uniform backlighting of the same luminous surface by different separate electrode groups nor are there actually separate luminous surfaces for separate electrode groups, which are nonetheless part of the invention.

A further possible application for locally separate electrode groups consists in using special optical films or similar devices to provide the. separate luminous surfaces for the electrode groups with different radiation directions or at least direction focal points, so that, on the whole, switching operation over between the electrode groups can change the radiation properties of the lamp in terms of direction as well.

The invention also relates to certain particularly interesting exemplary applications. Firstly, the invention relates to a traffic light in which the groups that can be operated in electrical isolation each correspond to one of the signal surfaces, although the overall traffic light contains only one standardized gas-discharge lamp. In this case, different luminescent materials can be used to produce the corresponding colors for the signal surfaces within the same gas-discharge lamp. With regard to preferred luminescent materials for this application and for other applications in the field of signal lamps, reference is made to the European application "Signallampe und Leuchtstoffe dazu [Signal lamp and luminescent materials therefor]" from the same applicant, with the file reference 97122800.2. As regards the physical shape of the traffic light lamp, reference is made, by way of addition, to the European application "Flache Signallampe mit dielektrisch behinderter Entladung [Flat signal lamp with dielectrically inhibited discharge]" from the same applicant, with the file reference 97122798.8.

Furthermore, the invention is specifically directed at signal lamps in vehicles, ships or airplanes and at display devices in them. Reference is made to the first exemplary embodiment. Motor vehicle rear lights, warning lights on operation panels etc. are also conceivable, however.

Finally, the invention also relates to an interior light in which the advantages of the invention can be used on the one hand for aesthetic reasons or on the other hand for regulating the luminous intensity.

DESCRIPTION OF THE DRAWINGS

The invention will now be illustrated with the aid of two specific exemplary embodiments which are shown schematically in the figures. Individual features disclosed in this context may also be essential to the invention in combinations other than those illustrated. Specifically:

FIG. 1 firstly shows the outer edge of a discharge volume denoted by 1, surrounded by two glass plates, lying flat in the plane of the drawing, and a seal running along the edge shown. In the lower area of the figure, the glass plates protrude beyond the discharge volume 1 by an extension denoted by 3. At the right-hand edge, the pump nozzle (in the closed state) used for evacuation and filling is shown. 2 summarily denotes the electrodes printed onto one of the plates, with cathodes and anodes running alternately in each case, although these are not distinguished more specifically in the figure because they do not differ in terms of quality and, in bipolar operation, the roles are no longer separate. The majority of the length of the electrodes 2 is situated in the discharge volume 1, and that part of the electrodes 2 that is situated outside the discharge volume 1 in the region of the extension 3 is connected to the supply circuit and motor vehicle electrical system.

Figure 1:
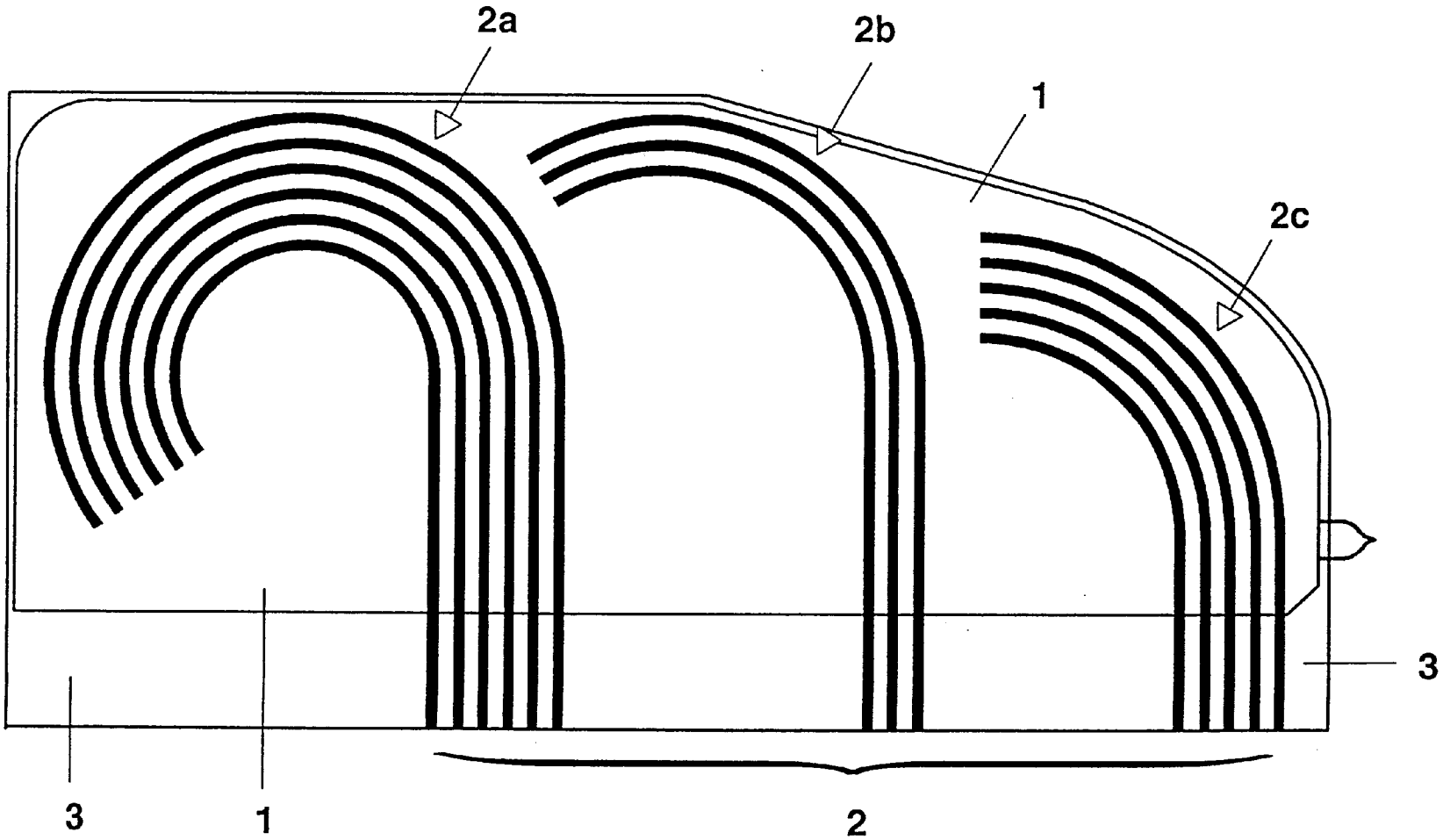
FIG. 1 shows a plan view of a flat radiating element for a motor vehicle "dashboard", intended to backlight a combined instrument for displaying the speed, engine speed, cooling water temperature and tank content.

The electrodes 2 are provided in three physically separate groups 2*a*, 2*b* and 2*c* which respectively correspond to particular display units and contents. Specifically, the left-hand group 2*a* corresponds to an analog instrument for speed indication and, apart from its straight section leading to the extension 3, follows the annular segment of this analog instrument. The same applies for group 2*b*, corresponding to a rev counter. In the case of group 2*c*, two instruments are combined, namely a fuel gauge and a cooling water thermometer.

In the present case, the purpose of this division is that, depending on the operating state of the motor vehicle, it is possible for only the information actually required for the driver to be shown on the dashboard. In all cases, this is the speedometer 2*a*. When the engine's maximum speed is reached, or at the request of the driver, the indicator 2*b* is added. Similarly, when the fuel tank is almost empty, or when the engine cooling water temperature is still low or is too high, and, of course, at the driver's request, the third unit 2*c* for backlighting the remaining two instruments can be switched on. In exactly the same way, individual monitoring and warning panels in the display device shown are switched on as required as well. The corresponding electrode structures each form further groups, but are not shown in the figure now for reasons of clarity. Normal warnings, for example "Handbrake on", "High beam on" etc., are conceivable.

The electrodes 2 are printed onto one of the two glass plates by screen printing. They are coated with a glass barrier as the dielectric. The distance between the two glass plates is roughly 7 mm, said plates being joined by means of glass solder as a seal via a glass frame forming the outer edge of the discharge volume 1. The discharge filling contained in the discharge volume tightly enclosed in this manner is a Xe filling at about 100 mbar (=10 kPa).

In addition, it is possible for the discharge volume to be filled at atmospheric pressure, that is to say at around 1 bar. A Xe partial pressure in the region of 100 mbar (=10 kPa) is then preferred. The difference between this partial pressure and the atmospheric pressure of the filling can be provided by another inert gas, for example Ne. Such a vacuum-free filling reduces the mechanical stress on the lamp vessel.

Other particulars regarding the technology of Xe excimer discharge lamps and regarding the pulsed manner of operation (in the present case bipolar) selected here can be found in the following applications, whose disclosed content is incorporated here by way of reference: WO 94/23 442 or DE-P 43 11 197.1 and WO 97/04625 or DE 195 26 211.5.

From the above exemplary embodiment, it is clear that the invention is distinguished, in contrast to the conventional use of curved fluorescent lamps or a number of incandescent lamps, by a technically simple design which can be produced efficiently and by the surface luminous intensity being distributed so as to be matched exactly to the design of the display device. This improves the utilization of energy and the ergonomics. Furthermore, flat radiating elements with dielectrically inhibited discharge are also particularly advantageous because they are very resistant to switching transients and insensitive to vibration, and their service life is essentially limited only by the stability of the luminescent materials used (maintenance). These advantages are important particularly in motorized transport in which repair or replacement is very complex and it is particularly unfavorable, for safety reasons, if a display device or its illumination fails. Another advantage may be the geometry of the flat radiating elements, whose shape and size can be matched particularly well to the place of use or installation, as is clear in this exemplary embodiment. In this case, the present invention still allows the use of simple housing shapes for flat radiating elements, in the present example the outer shape of the discharge volume 1 including the extension 3 instead of the complicated annular segments with connection pieces. The flatness is also advantageous in the context of the restricted space in a dashboard, cockpit etc. The same applies to the low weight.

In terms of the vacuum-free filling, already mentioned, of the discharge volume, considerably reduced wall thicknesses are possible, and it is also possible to omit support points or other stabilization measures which help to prevent implosion when vacuum fillings are used. This means that the flat radiating element can be made significantly lighter and is thus particularly well suited to the aforementioned applications.

Finally, another significant advantage is the fact that the individual "meaning segments" of the combined instrument can, according to the invention, be switched independently.

Figure 2:
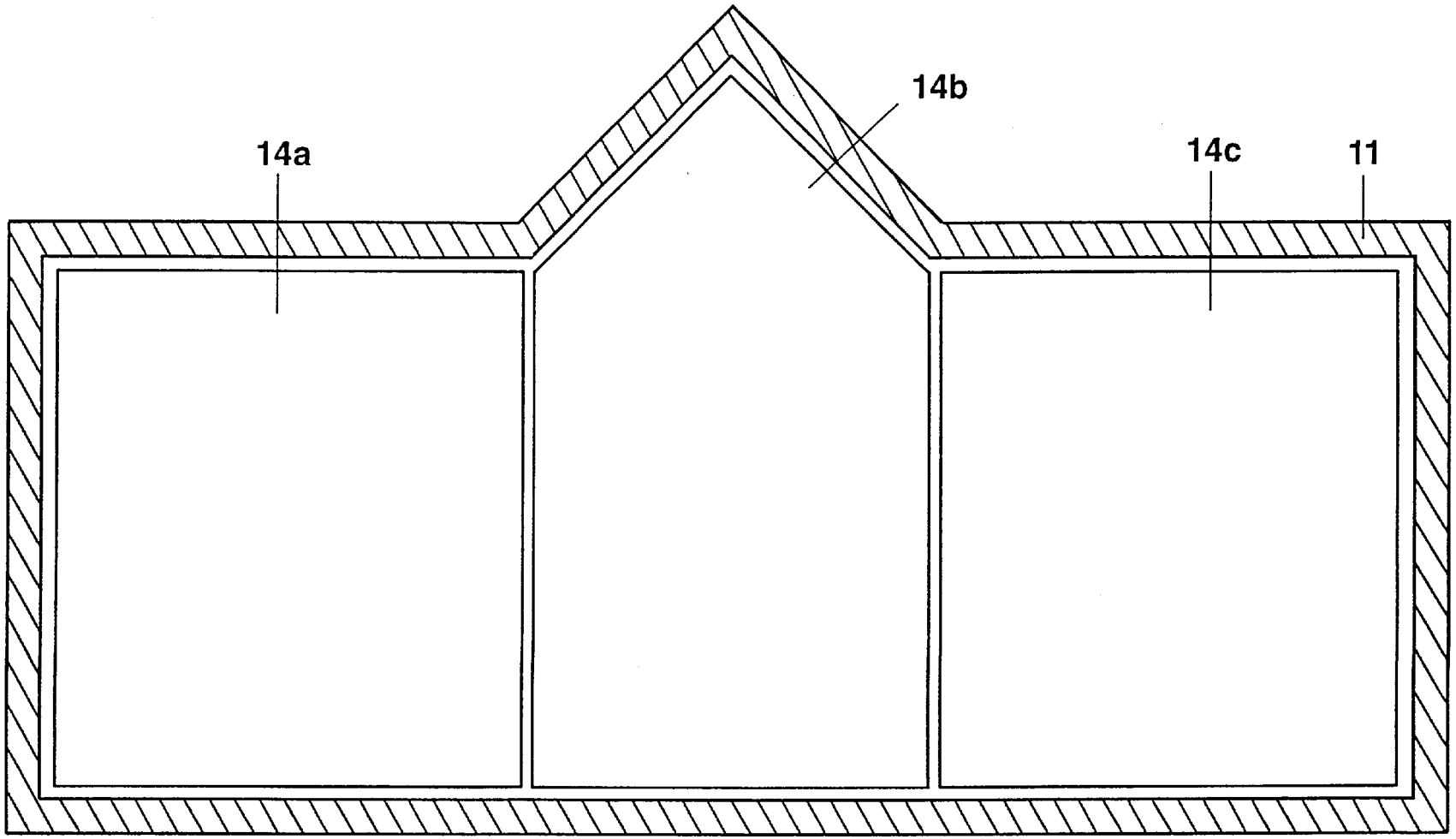
FIG. 2 shows a gas-discharge lamp according to the invention, having three luminous surfaces.
Figure 3:
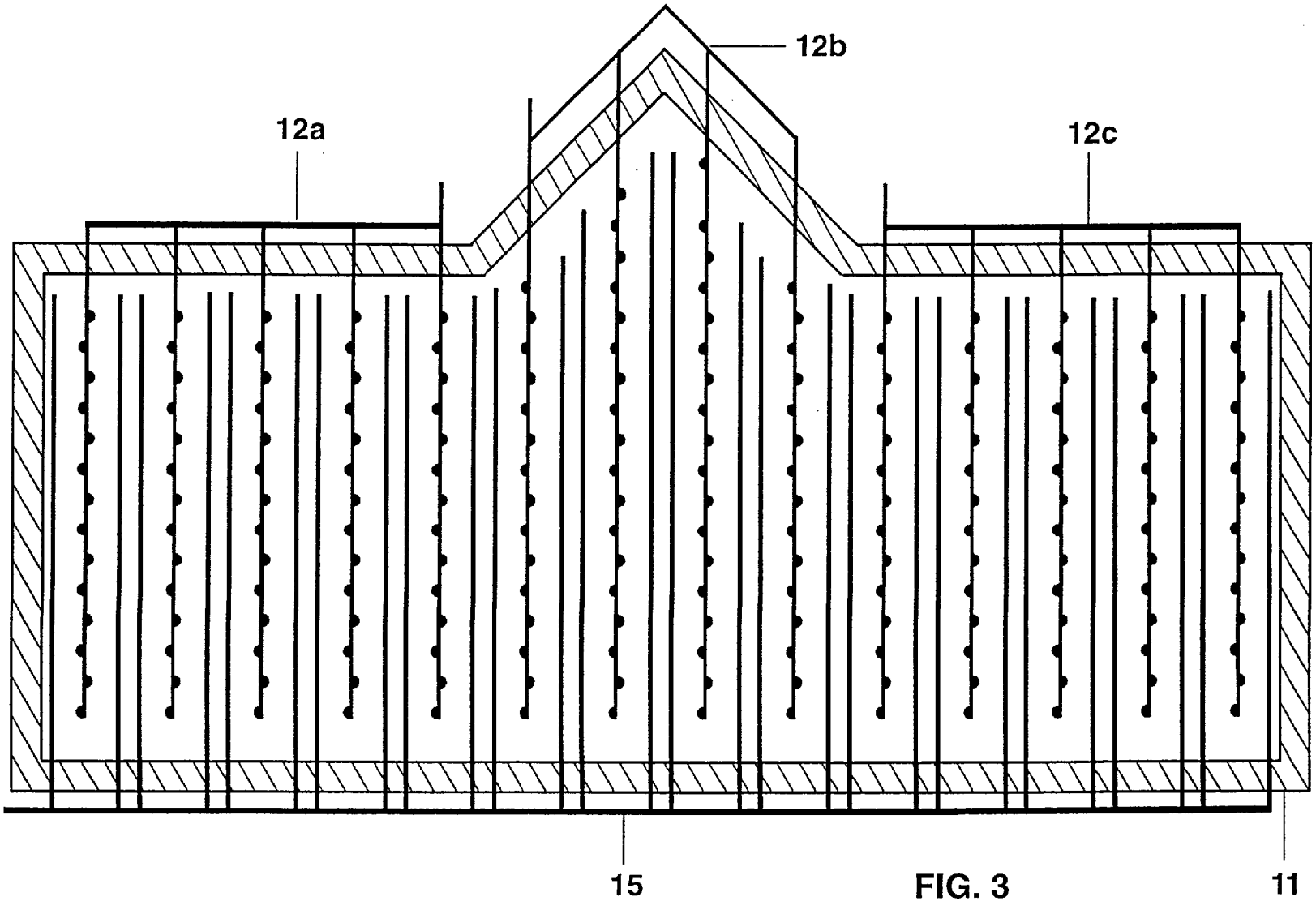
FIG. 3 shows the electrode structure of the gas-discharge lamp shown in FIG. 2.

The second and the third exemplary embodiments show applications in the field of interior lighting. FIG. 2 shows an interior light comprising a lamp with three luminous surfaces 14*a*, 14*b*, 14*c*, which take up the inner surface of a frame 11. FIG. 3 shows the associated electrode structure. The electrodes as a whole comprise one comb-like anode structure 15 and three respective comb-like cathode groups 12*a*, 12*b*, 12*c*. The cathode groups and the anodes of the comb-like structure 15 are interleaved such that respective pairs of anode strips are situated between adjacent cathodes. Furthermore, individual anode strips are situated at each of the two outermost ends.

The electrode geometry selected here is geared to a unipolar voltage for inputting power pulses. In this arrangement, the cathode strips have lug-like projections, pointing to the sides of the respectively adjacent anode strips, for localizing individual partial discharges, as described in more detail in DE 196 36 965.7.

With this exemplary embodiment, it is clear, in particular, that the electrodes do not need to be subdivided, according to the invention, into separately operable groups by electrically connecting the two "electrode types" such that they are separated according to group. Instead, in the present case, all of the anodes 15 can be connected together and connected to a constant reference-ground potential. By applying the real power input pulses already mentioned (cf. the cited prior art) to the individual cathode groups 12*a*, 12*b*, 12*c*, it is then possible for discharges to be ignited between the respective cathode group and the corresponding part of the comb-like anode structure 15.

The common connections of the cathode strips in a group and of the anode strips are situated at the end of a bus-like structure outside the discharge vessel bounded by the frame 11. The electrode strips are in this case easily routed through between the frame 11 and a bottom or cover plate (not shown) of the discharge vessel, specifically in the same manner produced by screen printing as they run as electrode strips in the interior of the discharge vessel. To this end, reference is also made to the disclosed content of the German applications "Flachleuchtstofflampe für die Hintergrundbeleuchtung und Flüssigkristallanzeige-Vorrichtung mit dieser Flachleuchtstofflampe [Flat fluorescent lamp for background lighting and liquid-crystal display device having this flat fluorescent lamp]", with the file reference 197 11 890.9 from the same applicant, and "Flachleuchtstofflampe für die Hintergrundbeleuchtung und Fl üssigkristallanzeige-Vorrichtung mit dieser Flachleuchtstofflampe [Flat fluorescent lamp for background lighting and liquid-crystal display device having this flat fluorescent lamp]", with the file reference 197 29 181.3 from the same applicant, and the application "Gasentladungslampe mit dielektrisch behinderten Elektroden [Gas-discharge lamp having dielectrically inhibited electrodes]", with the file reference PCT/DE98/00826 (=WO98/43276) from the same applicant. This also applies, furthermore, to the first exemplary embodiment above.

Figure 4:
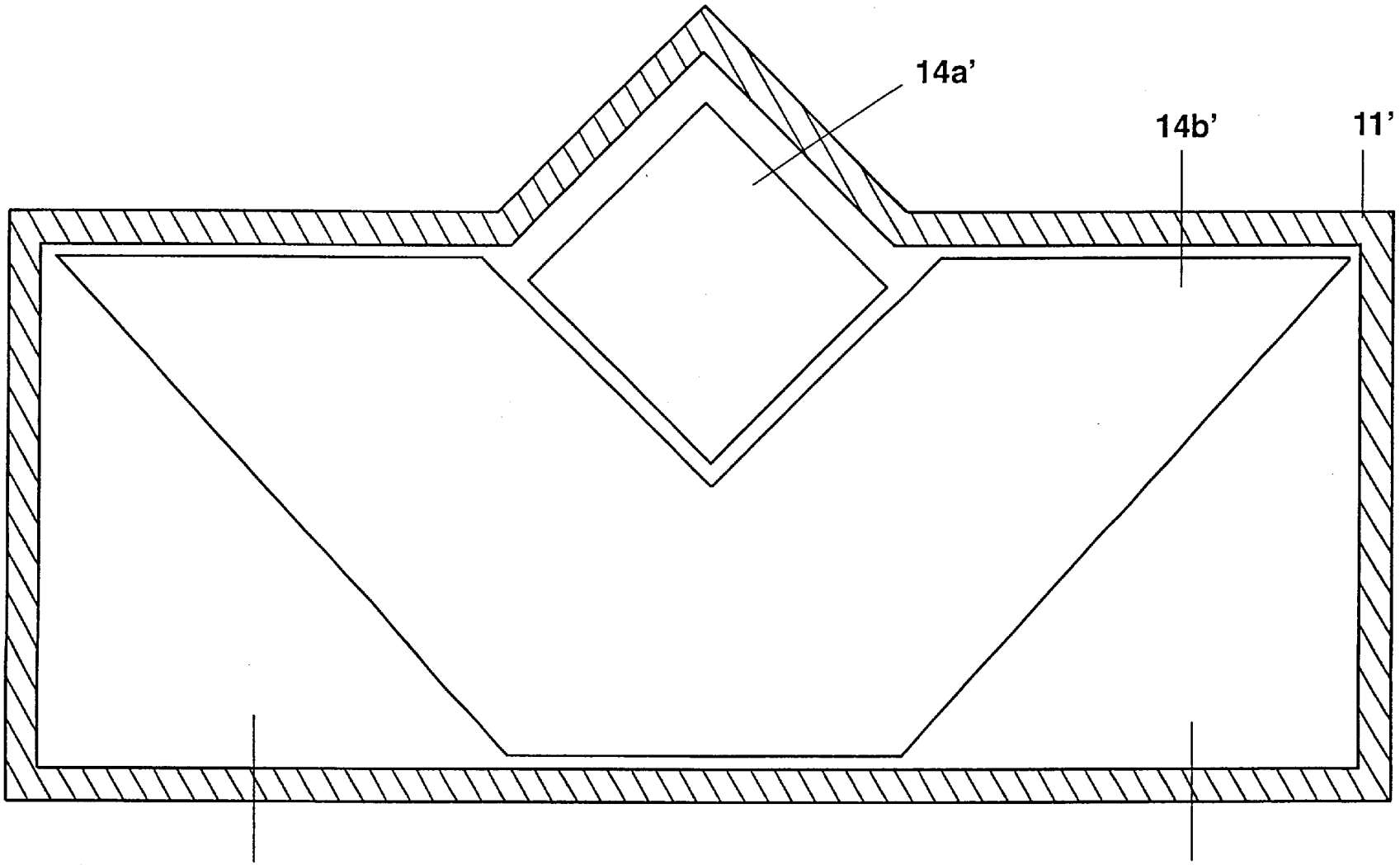
FIG. 4 shows a second gas-discharge lamp according to the invention, having three luminous surfaces, but in a different geometrical arrangement than in FIG. 2.
Figure 5:
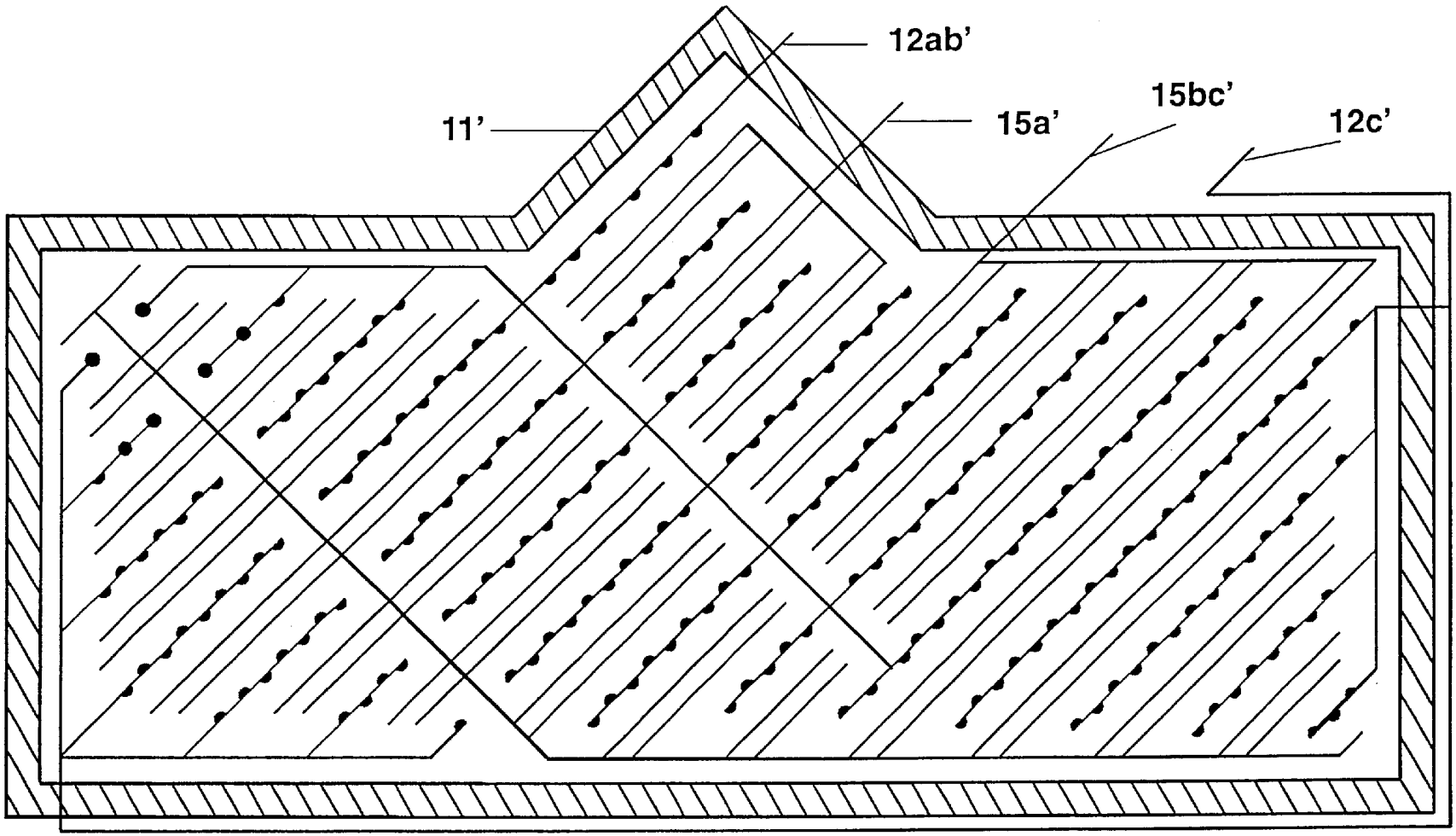
FIG. 5 shows the electrode structure for the gas-discharge lamp shown in FIG. 4.

The following third exemplary embodiment is shown in FIGS. 4 and 5 in a similar way to in FIGS. 2 and 3, where reference symbols with a stroke added denote the corresponding analog components. In this case, the difference between the second and the third exemplary embodiment is merely the different geometry of the electrodes and the correspondingly different geometry of the luminous surfaces 14*a*', 14*b*', 14*c*'.

FIG. 5 also shows, in particular, that the bus-like junctions of the cathodes and the anodes in this case run inside the discharge volume, because the oblique arrangement of the electrode strips relative to the largest part of the frame 11' of the discharge vessel together with the division of the electrodes is easier to produce in this way.

Furthermore, in this exemplary embodiment, not all the anode strips are joined to form a common connection. Instead, there are two anode groups 15*a*' and 15*bc*', which are respectively assigned to the luminous surface 14*a*' and the sum of the two luminous surfaces 14*b*' and 14*c*'. Accordingly, this exemplary embodiment has not three but only two cathode groups 12*ab*' and 12*c*', which are respectively assigned to the entity formed by the two luminous surfaces 14*a*' and 14*b*' and the luminous surface 14*c*'. This is intended to show clearly that the separately operable electrode groups do not necessarily have to involve subdivision of one of the two "electrode types". Specifically, in this case, it is only the interaction of the anode subdivision and the cathode subdivision that produces the division into three luminous surfaces.

It is easy to see that all three luminous surfaces 14*a*', 14*b*', 14*c*' can each be operated in isolation. However, this exemplary embodiment has the disadvantage that the luminous surface 14*a*' and the luminous surface 14*c*' cannot be operated together without also operating the luminous surface 14*b*' at the same time. The reason for this is that operation of the luminous surface 14*a*' requires a supply to the cathode group 12*ab*' and the anode group 15*a*', whilst operation of the luminous surface 14*c*' requires a supply to the cathode group 12*c*' and the anode group 15*bc*'. This means that the anodes and the cathodes for the luminous surface 14*b*' are automatically supplied as well.

As mentioned above, the second and the third exemplary embodiment relate to an interior light which for decorative reasons is divided into various luminous surfaces which can be switched independently of one another. It would also be conceivable, however, for the gas-discharge lamp illustrated in the second and the third exemplary embodiment to be taken as being an advertising surface representing a respective company logo, it being possible for the individual segments to be made to flash alternately, for example, in order to make the advertisement more conspicuous.

What is claimed is:

1. A gas-discharge lamp having a discharge vessel which is filled with a gas filling, has a multiplicity of electrodes and has a dielectric layer between at least one anode part of the electrodes and the gas filling, wherein the electrodes are divided into separately operable groups for independently switchable operation and said groups are areally distributed and correspond to different luminous surfaces which can be operated independently.

2. The gas-discharge lamp as claimed in claim 1, having an optical display device or signal device in which the groups are assigned to surface shapes of the display device or signal device which can each be illuminated.

3. The gas-discharge lamp as claimed in claim 1 in which at least some of the electrodes have an areally inhomogeneous electrode geometry for local modulation of the surface luminous intensity.

4. The gas-discharge lamp as claimed in claim 2 in which the electrode geometry of the associated electrode groups is matched to the respective surface shape to be illuminated.

5. The gas-discharge lamp as claimed in claim 4 as a flat radiating element for backlighting annular or circular, circle-segment-shaped, annular-segment-shaped analog displays.

6. The gas-discharge lamp as claimed in claim 1, in which electrodes in different separately operable electrode groups are arranged interleaved with one another so as to be able to produce discharge structures independently of one another in essentially the same surface region, so that the surface region can be selectively illuminated using one of the two or both electrode groups.

7. The gas-discharge lamp as claimed in claim 2, in which electrodes in different separately operable electrode groups are arranged interleaved with one another so as to be able to produce discharge structures independently of one another in essentially the same surface region, so that the surface region can be selectively illuminated using one of the two or both electrode groups.

8. The gas-discharge lamp as claimed in claim 1 in which the electrodes are connected by internal bus-like junctions.

9. The gas-discharge lamp as claimed in claim 1 in which the electrodes are arranged in interleaved comb-like groups.

10. The gas-discharge lamp as claimed in claim 8 in which the electrodes are connected by internal bus-like junctions.

11. The gas-discharge lamp as claimed in claim 1 in which the electrode groups are independently dimmable.

12. The gas-discharge lamp as claimed in claim 6 in which the electrode groups are independently dimmable.

* * * * *